US009352453B2

(12) United States Patent
Chern

(10) Patent No.: US 9,352,453 B2
(45) Date of Patent: May 31, 2016

(54) MULTIPLE-FUNCTION HAND TOOL

(71) Applicant: Shwu-Ruu Chern, Taichung (TW)

(72) Inventor: Shwu-Ruu Chern, Taichung (TW)

( * ) Notice: Subject to any disclaimer, the term of this patent is extended or adjusted under 35 U.S.C. 154(b) by 250 days.

(21) Appl. No.: 14/106,718

(22) Filed: Dec. 14, 2013

(65) Prior Publication Data

US 2015/0165597 A1 Jun. 18, 2015

(51) Int. Cl.

| | |
|---|---|
| ***B25B 7/04*** | (2006.01) |
| ***B25B 7/18*** | (2006.01) |
| ***B25B 7/14*** | (2006.01) |
| ***B25B 7/08*** | (2006.01) |
| ***B25B 13/14*** | (2006.01) |
| ***B25F 1/00*** | (2006.01) |

(52) U.S. Cl.

CPC ... *B25B 7/04* (2013.01); *B25B 7/08* (2013.01); *B25B 7/14* (2013.01); *B25B 7/18* (2013.01); *B25B 13/14* (2013.01); *B25F 1/003* (2013.01)

(58) Field of Classification Search

CPC ..... B25B 7/04; B25B 7/08; B25B 7/14; B25B 7/18; B25B 7/22; B25B 13/14; B25F 1/003

USPC ..... 81/318, 165, 179, 385; 7/125, 139

See application file for complete search history.

(56) References Cited

U.S. PATENT DOCUMENTS

| | | | | | |
|---|---|---|---|---|---|
| 874,394 | A * | 12/1907 | Cork | B25B 7/02 | 7/134 |
| 5,150,488 | A * | 9/1992 | Yuan | B25B 7/04 | 7/137 |
| 7,424,838 | B2 * | 9/2008 | Li | B25B 7/22 | 7/129 |
| 2004/0163505 | A1 * | 8/2004 | Durham | B25B 7/04 | 81/355 |

* cited by examiner

*Primary Examiner* — Hadi Shakeri

(74) *Attorney, Agent, or Firm* — Pro-Techtor International Services; Ian Oglesby

(57) ABSTRACT

A hand tool includes a first part and a second part which is pivotably connected to the first part. The first part has a first jaw. An assistance member is connected to the first part and has a second jaw connected there. The assistance member has an adjustment screw, the second jaw is movable by rotating the adjustment screw. The user uses the first and second parts as the conventional pliers. A locking member is located in the positioning hole of the first part and can lock the relative position of the first and second parts. The second jaw is then adjusted relative to the first jaw by rotating the adjustment screw to be functioned as an adjustment wrench.

3 Claims, 10 Drawing Sheets

MULTIPLE-FUNCTION HAND TOOL

BACKGROUND OF THE INVENTION

1. Fields of the Invention

The present invention relates to a hand tool, and more particularly, to a multiple-function hand tool which combines pliers and adjustable wrench to quickly clamp objects.

2. Descriptions of Related Art

The conventional hand tool such as the pliers comprises two handles and two jaws connected to the two handles. The two handles are pivotably connected to each other. The user pulls the two handles toward each other to clamp the object between the two jaws. The user has to apply a significant force to hold the two handles to keep the two jaws to clamp the object.

Another hand tool such as the adjustable wrench which comprises a fixed jaw and a movable jaw. The movable jaw is moved relative to the fixed jaw by rotating an adjustment screw. The movable jaw is then positioned at the desired position without holding the handle. However, it takes time to rotate the adjustment screw to adjust the movable jaw.

The present invention intends to provide a multiple-function hand tool which improves the shortcomings mentioned above.

SUMMARY OF THE INVENTION

The present invention relates to a hand tool and comprises a first part having a first pivotal portion which has a first handle and a first jaw on two ends thereof. The first pivotal portion has a first pivotal hole, a first insertion hole and a positioning hole. The positioning hole has a first positioning setting and a second positioning setting defined in one surface of the first pivotal hole.

A second part has a second pivotal portion which has a second handle which is located corresponding to the first handle. The second pivotal portion has a first protrusion and a second insertion hole. The first protrusion is inserted into the first insertion hole of the first part.

An assistance member has a third pivotal portion which has a second pivotal hole located corresponding to the first pivotal hole of the first part. The third pivotal portion has a second protrusion located corresponding to the second insertion hole of the second part. The third pivotal portion has an adjustment head located corresponding to the first jaw of the first paw. The adjustment head has an adjustment screw connected thereto which is threadedly engaged with a second jaw which is moved relative to the first jaw by rotating the adjustment screw.

A pivot extends through the first pivotal hole of the first part and the second pivotal hole of the assistance member. A locking member has an engaging member on the outside thereof. The locking member is located in the positioning hole of the first part. The engaging member is located in the first positioning setting of the positioning hole.

Preferably, the third pivotal portion of the assistance member has a slot which is located corresponding to the positioning hole of the first part.

Preferably, the locking member is a cylindrical member.

Preferably, the first and second positioning settings of the positioning hole are two notches.

The primary object of the present invention is to provide a hand too with different functions which meet requirements in different tasks.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 3 is a perspective view to show the of the present invention;

DETAILED DESCRIPTION OF THE PREFERRED EMBODIMENT

Figure 1:
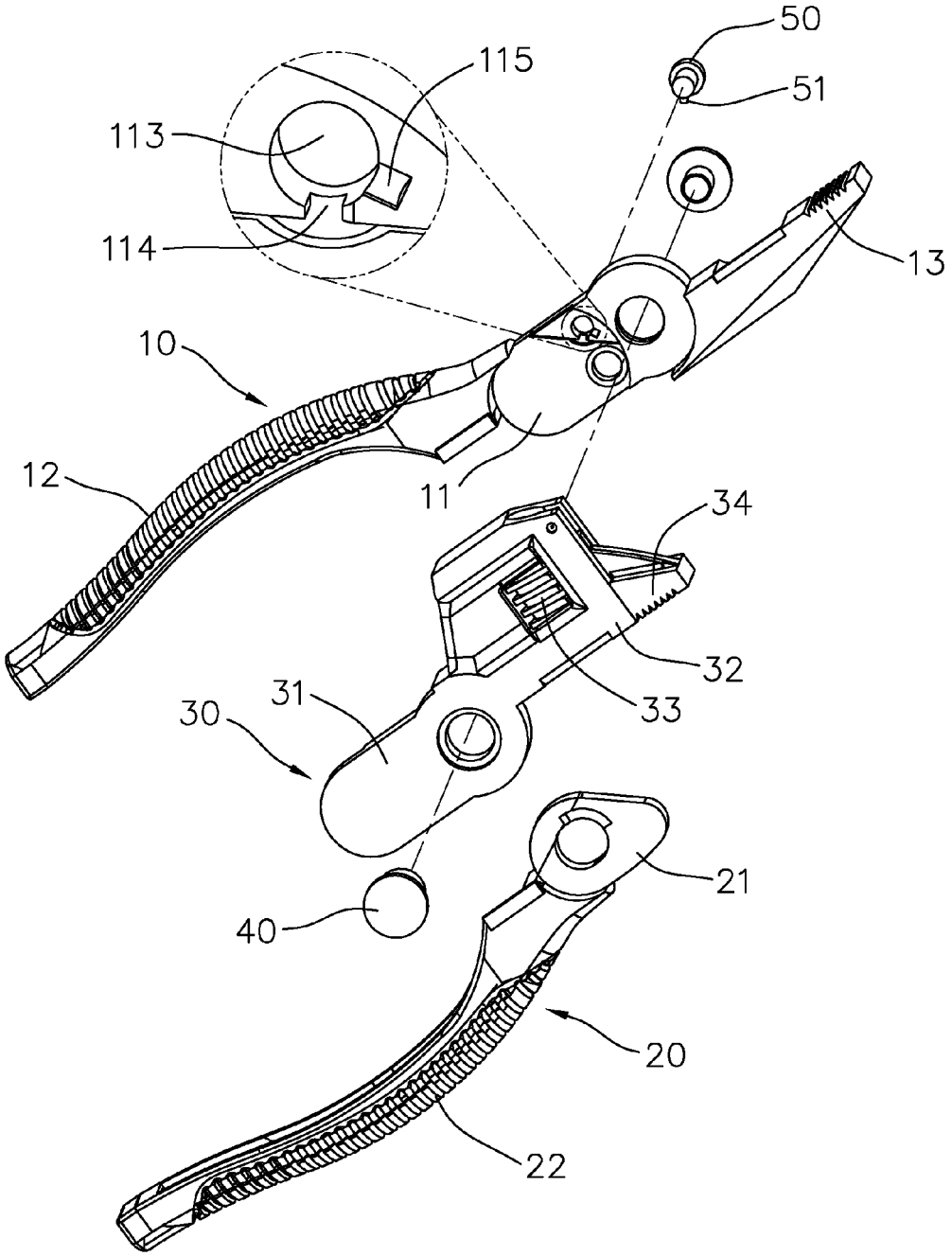
FIG. 1 is an exploded view of the hand tool of the present invention.
Figure 2:
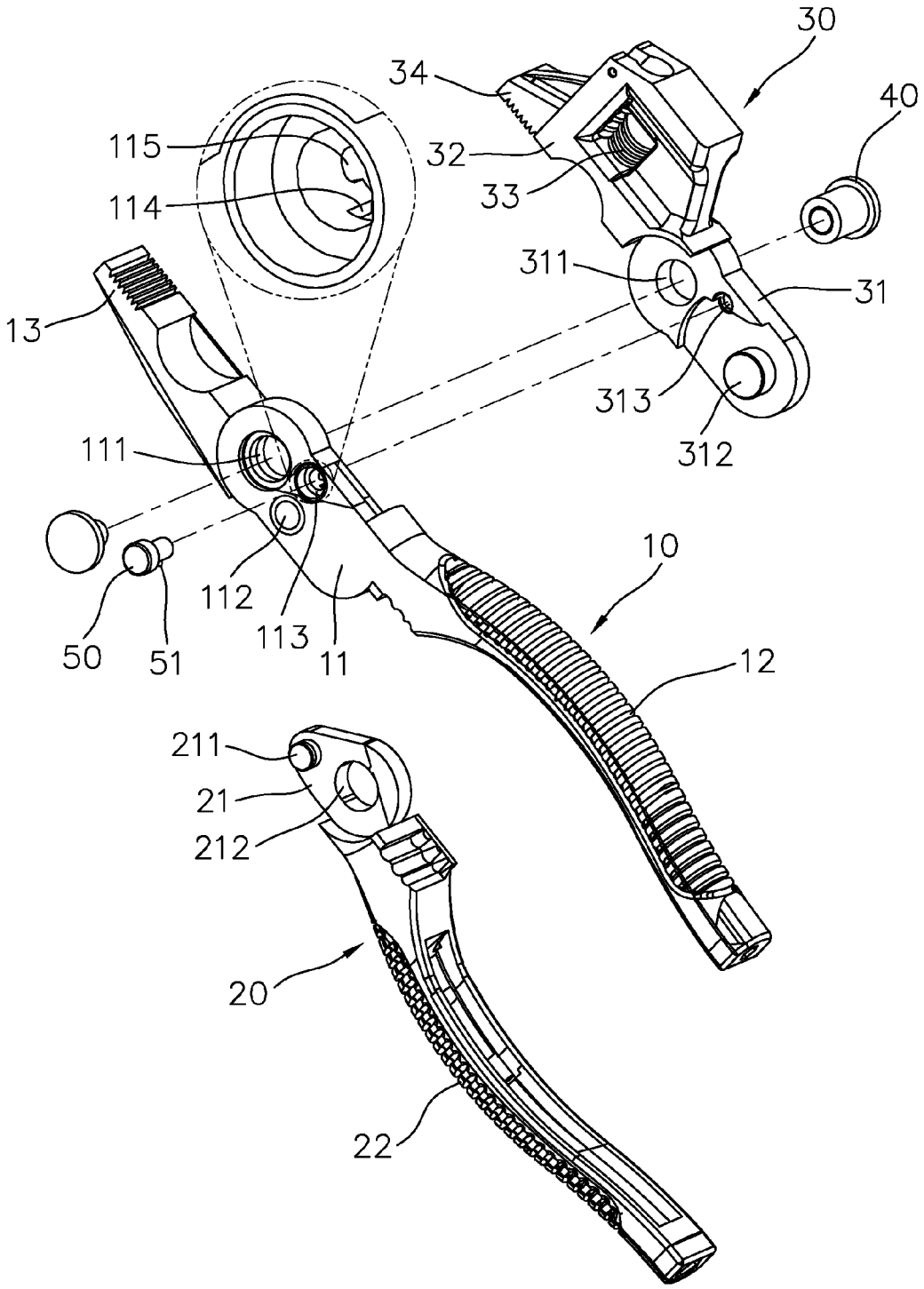
FIG. 2 is another exploded view of the hand tool of the present invention.
Figure 3:
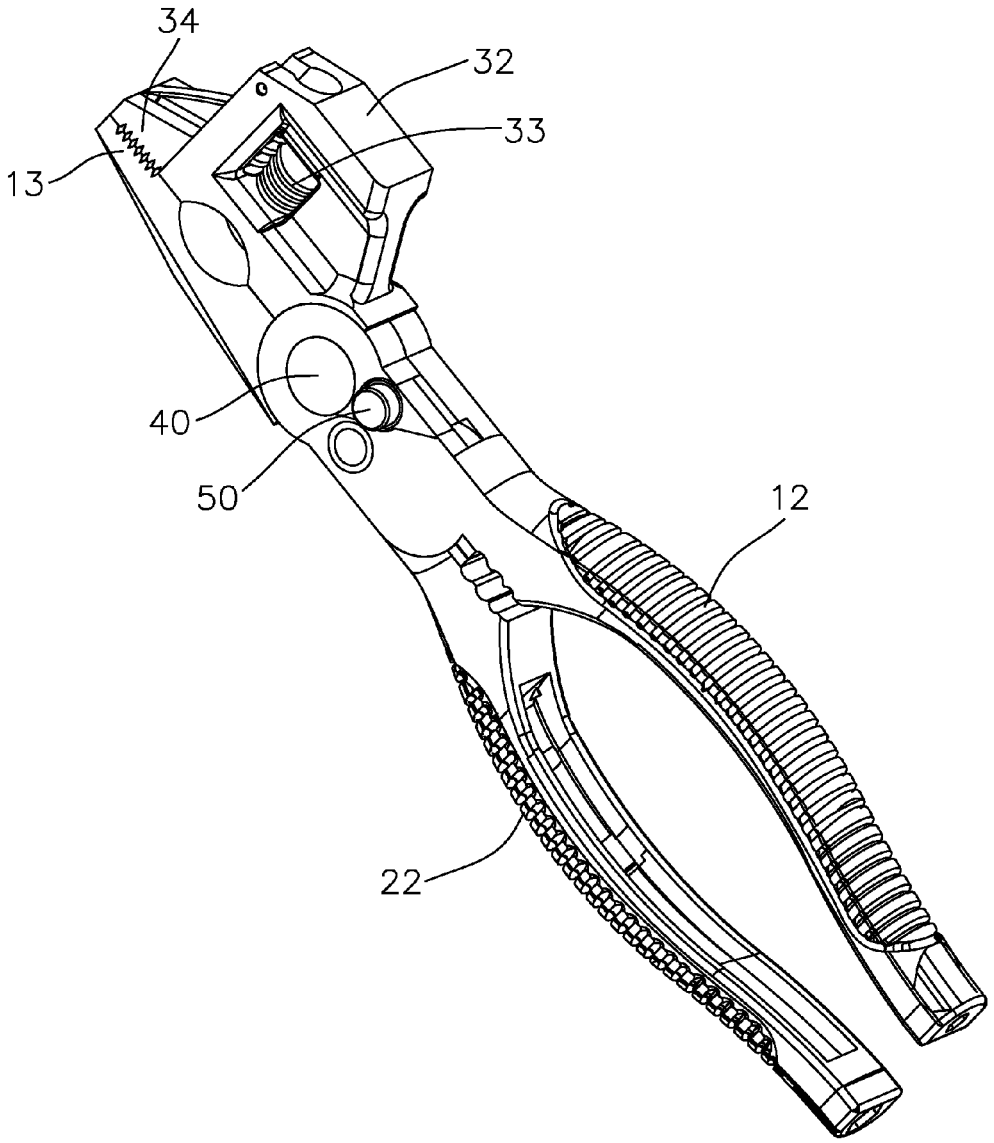
FIG. 3 is a perspective view to show the hand tool of the present invention.

Referring to FIGS. 1 to 11, the hand tool of the present invention comprises a first part 10 having a first pivotal portion 11 which has a first handle 12 and a first jaw 13 on two ends thereof. The first pivotal portion 11 has a first pivotal hole 111, a first insertion hole 112 and a positioning hole 113. The positioning hole 113 has a first positioning setting 114 and a second positioning setting 115 defined in one surface of the first pivotal hole 11. In this embodiment, the first and second positioning settings 114, 115 of the positioning hole 113 are two notches.

A second part 20 has a second pivotal portion 21 which has a second handle 22 which is located corresponding to the first handle 12. The second pivotal portion 21 has a first protrusion 211 and a second insertion hole 212. The first protrusion 211 is inserted into the first insertion hole 112 of the first part 10.

An assistance member 30 has a third pivotal portion 31 which has a second pivotal hole 311 located corresponding to the first pivotal hole 111 of the first part 10. The third pivotal portion 31 has a second protrusion 312 located corresponding to the second insertion hole 212 of the second part 20. The third pivotal portion 31 having a slot 313 which is located corresponding to the positioning hole 113 of the first part 10. The third pivotal portion 31 has an adjustment head 32 located corresponding to the first jaw 13 of the first paw 10. The third pivotal portion 31 of the assistance member 30 has a slot 313 which is located corresponding to the positioning hole 113 of the first part 10. The adjustment head 32 has an adjustment screw 33 connected thereto which is threadedly engaged with a second jaw 34 so that the second jaw 34 is moved relative to the first jaw 13 by rotating the adjustment screw 33.

A pivot 40 extends through the first pivotal hole 111 of the first part 10 and the second pivotal hole 311 of the assistance member 30. A locking member 50, which is a cylindrical member, has an engaging member 51 on the outside thereof. The locking member 50 is located in the positioning hole 113 of the first part 10. The engaging member 51 is located in the first positioning setting 114 of the positioning hole 113.

Figure 4:
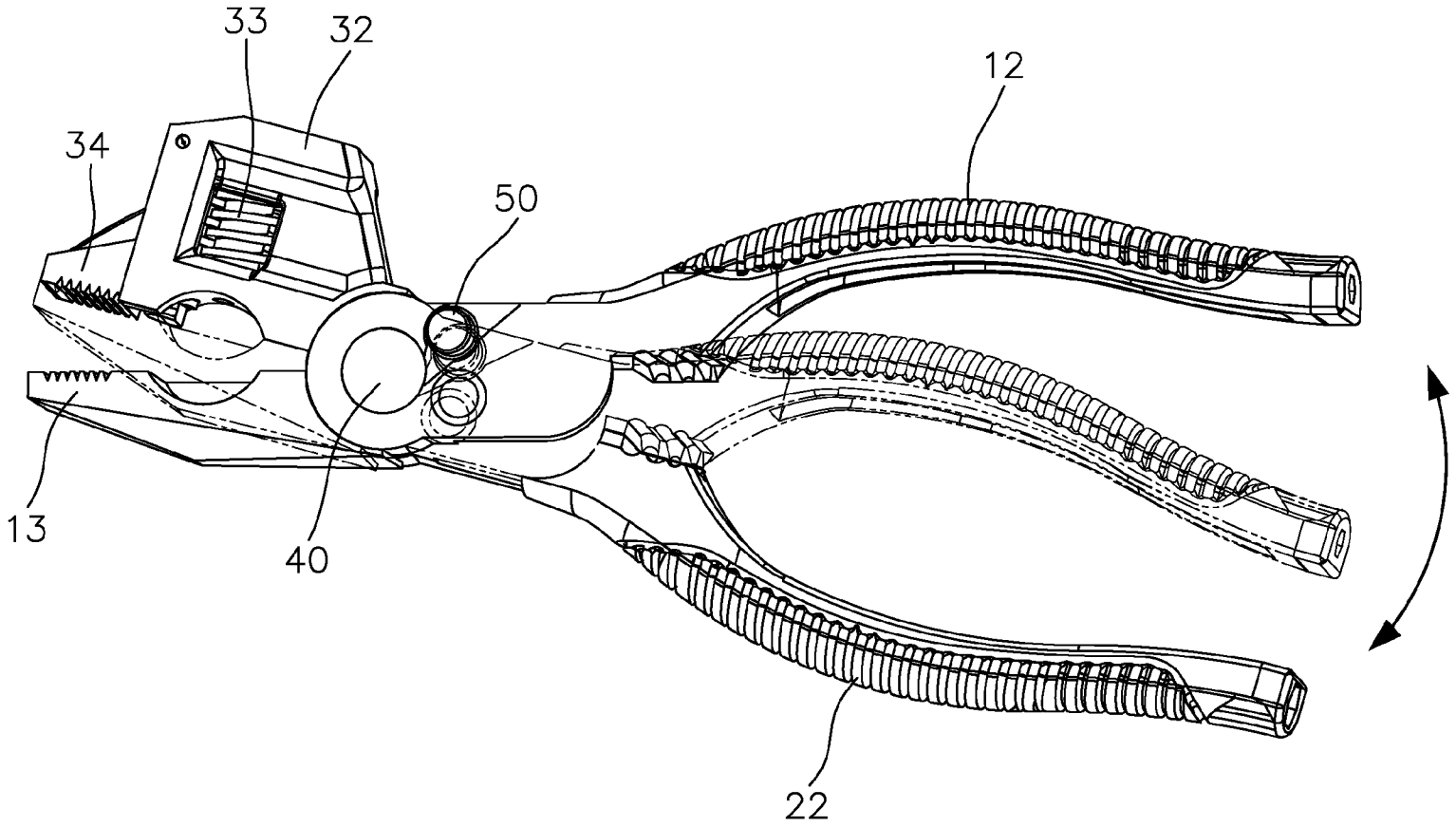
FIG. 4 shows the operation to the two handles of the hand tool of the present invention.

As shown in FIG. 4, the user may hold the two handles 12, 22 to pivot the first and second parts 10, 20 about the pivot 40 to clamp an object by the first and second jaws 13, 34.

Figure 5:
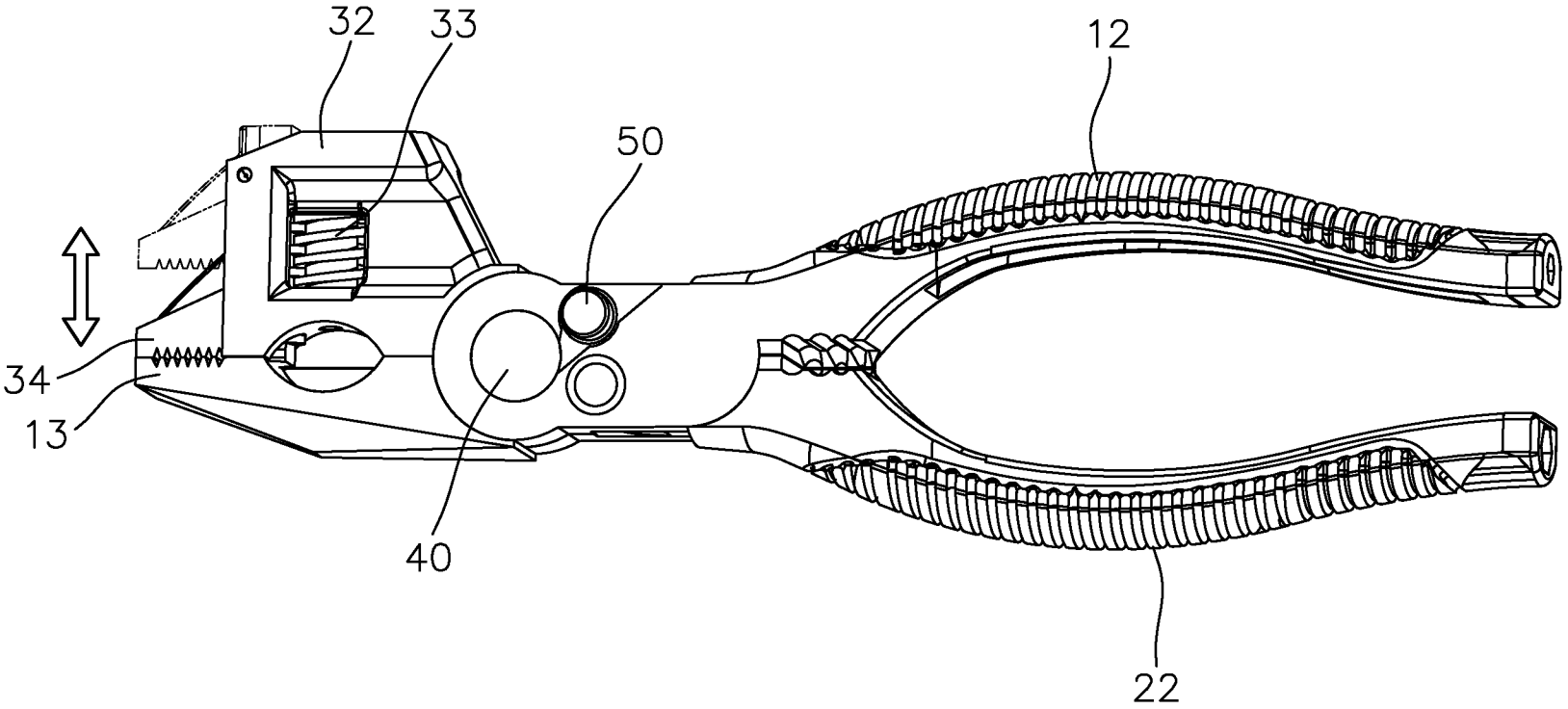
FIG. 5 shows that the second jaw is moved by rotating the adjustment screw.

As shown in FIG. 5, the third pivotal portion 31 has the adjustment head 32 which has the adjustment screw 33 connected thereto so as to move the second jaw 34 toward or away from the first jaw 13 by rotating the adjustment screw 33.

Figure 6:
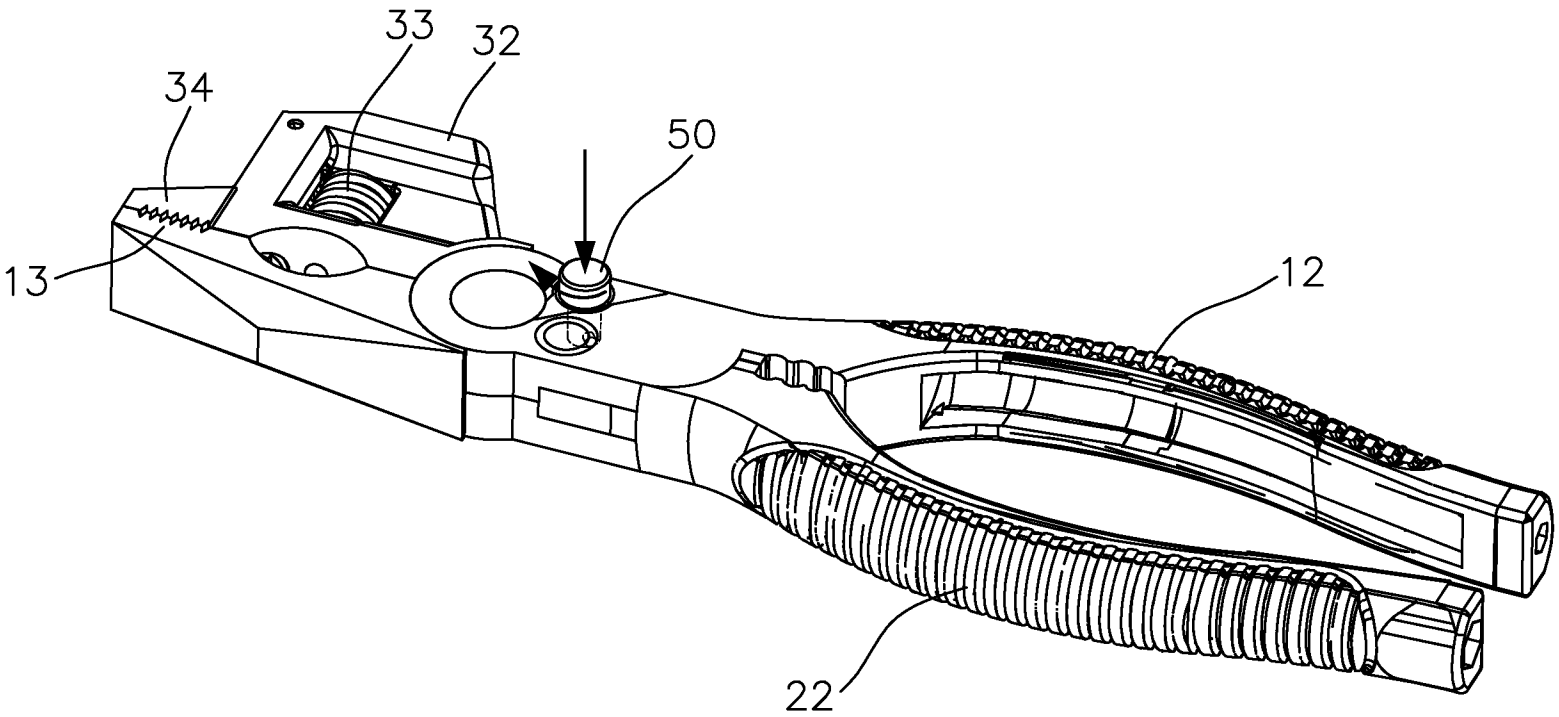
FIG. 6 shows the operation to the locking member of the hand tool of the present invention.
Figure 7:
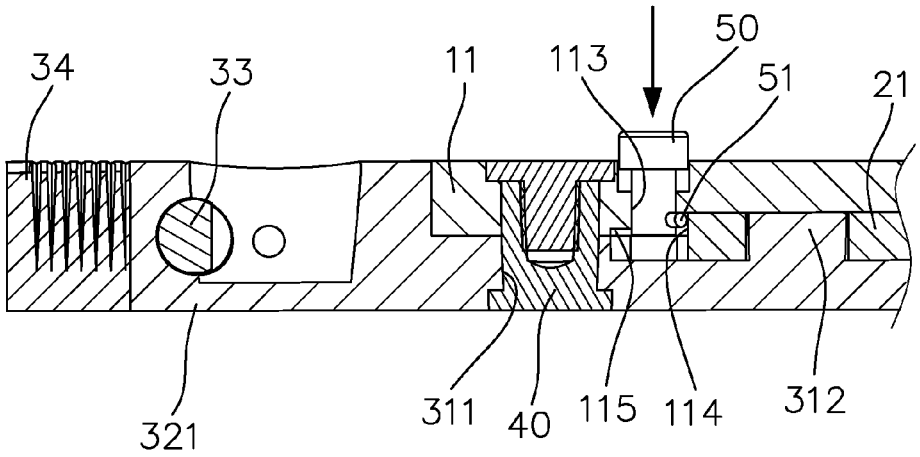
FIG. 7 is a cross sectional view to show that the locking member is pushed downward.
Figure 8:
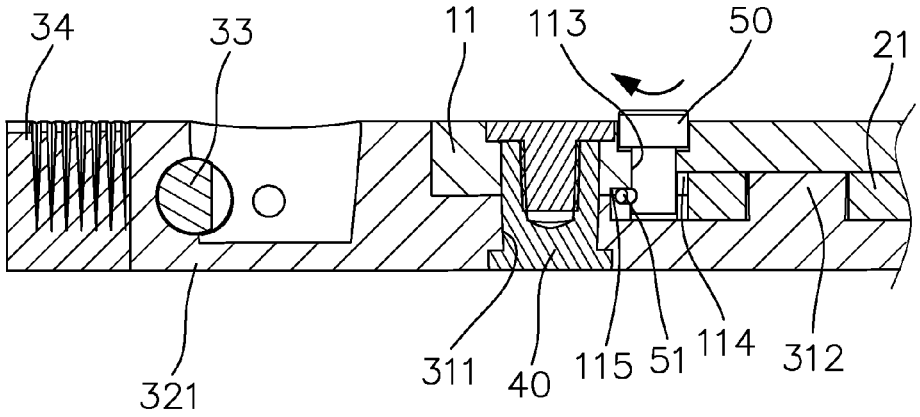
FIG. 8 is a cross sectional view to show that the locking member is rotated.

As shown in FIGS. 6 and 7, the user can push the locking member 50 downward and rotate the locking member 50 to move the engaging member 51 of the locking member 50 from the first positioning setting 114 to the second positioning setting 115 as shown in FIG. 8 to position the first part 10 and the assistance member 30 at the desired position. Then the adjustment screw 33 is rotated to move the second jaw 34 relative to the first jaw 13. It is noted that when pushing the locking member 50, the locking member 50 moves downward and then is engaged with the slot 313. The engaging member 51 of the locking member 50 is moved from the first positioning setting 114 to the second positioning setting 115 as shown in FIG. 8 to position the first part 10 and the assistance member 30 at the desired position.

Figure 9:
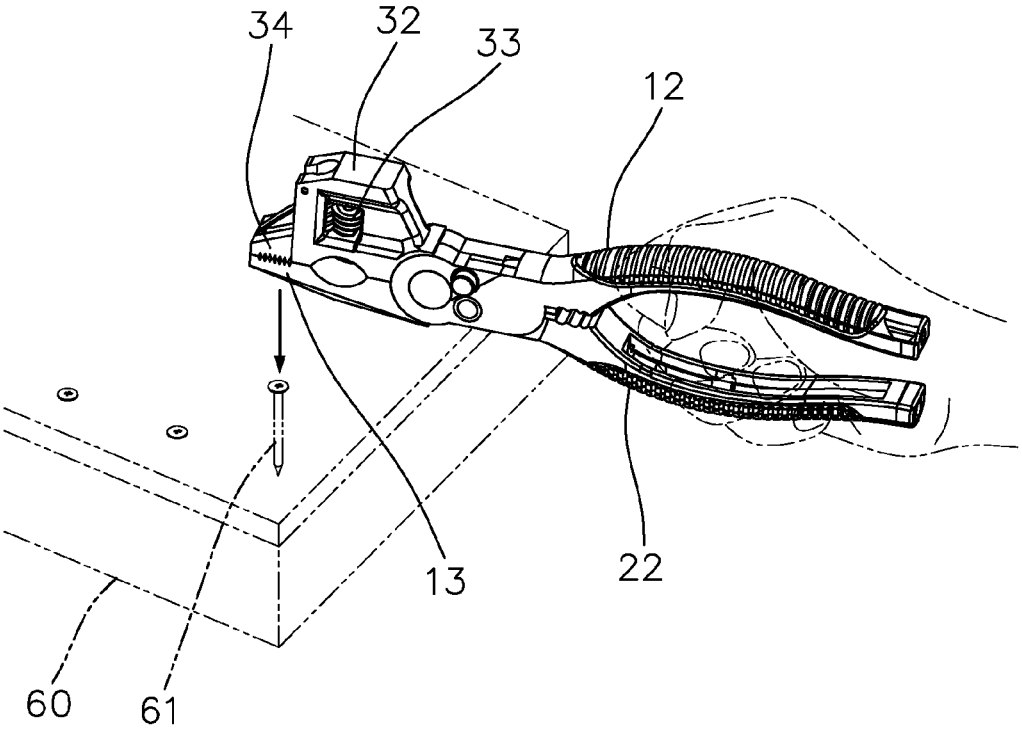
FIG. 9 shows that the hand tool of the present invention is used as a hammer.
Figure 10:
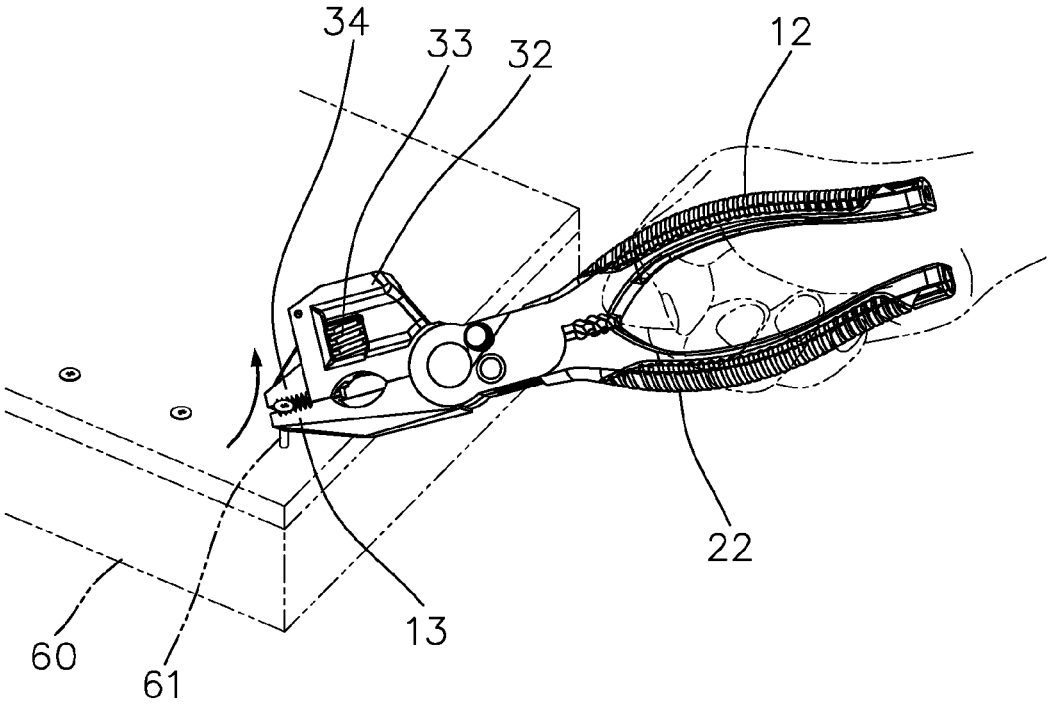
FIG. 10 shows that the hand tool of the present on is used as pliers.
Figure 11:
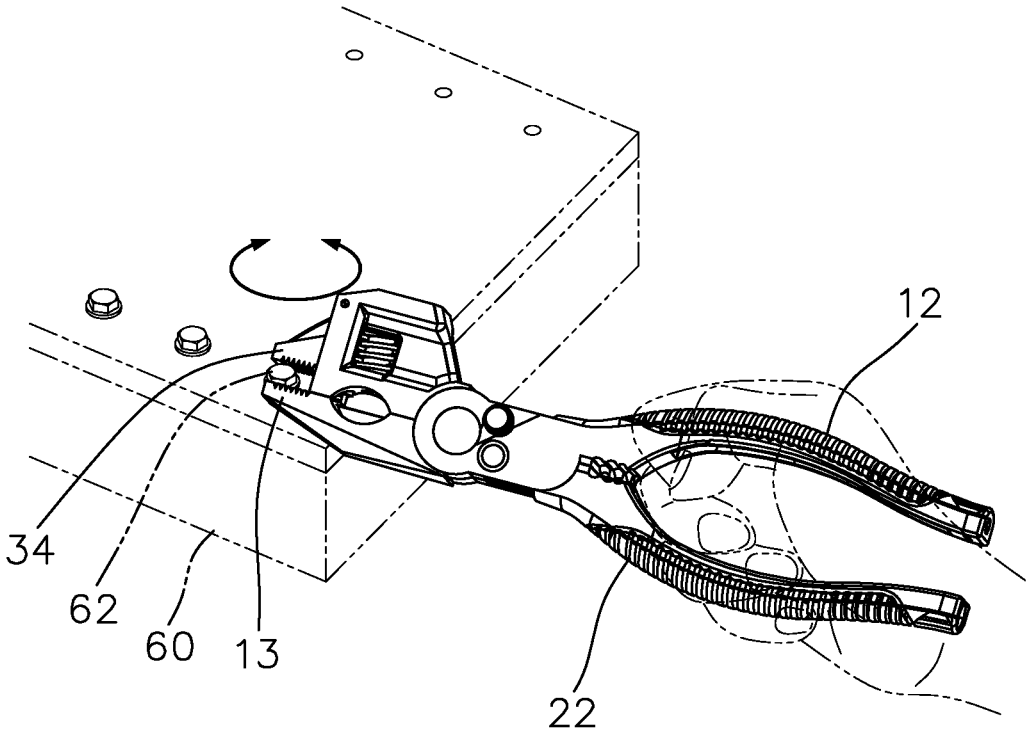
FIG. 11 shows that the hand tool of the present invention is used as an adjustment wrench.

FIG. 9 shows that the hand tool of the present invention is used as a hammer by hammering the nail 61 on the object 60 by the outside of the first jaw 13. FIG. 10 shows that the hand tool of the present invention is used as pliers by clamping the nail 61 on the object 60 by the first and second jaws 13, 34. FIG. 11 shows that the hand tool of the present invention is used as an adjustment wrench by micro-adjusting the distance between the first and second jaws 13, 34 by rotating the adjustment screw 33.

While we have shown and described the embodiment in accordance with the present invention, it should be clear to those skilled in the art that further embodiments may be made without departing from the scope of the present invention.

What is claimed is:

1. A hand tool comprising:

a first part having a first pivotal portion which has a first handle and a first jaw on two ends thereof, the first pivotal portion having a first pivotal hole, a first insertion hole and a positioning hole, the positioning hole having a first positioning setting and a second positioning setting;

a second part having a second pivotal portion which has a second handle which is located corresponding to the first handle, the second pivotal portion having a first protrusion and a second insertion hole, the first protrusion being inserted into the first insertion hole of the first part;

an assistance member having a third pivotal portion which has a second pivotal hole located corresponding to the first pivotal hole of the first part, the third pivotal portion having a second protrusion located corresponding to the second insertion hole of the second part, the third pivotal portion having a slot which is located corresponding to the positioning hole of the first part, the third pivotal portion having an adjustment head located corresponding to the first jaw of the first part, the adjustment head having an adjustment screw connected thereto which is threadedly engaged with a second jaw which is moved relative to the first jaw by rotating the adjustment screw;

a pivot extending through the first pivotal hole of the first part and the second pivotal hole of the assistance member, and a locking member having an engaging member on an outside thereof, the locking member located in the positioning hole of the first part, the engaging member engaging with either positioning setting of the positioning hole.

2. The hand tool as claimed in claim 1, wherein the locking member is a cylindrical member.

3. The hand tool as claimed in claim 1, wherein the first and second positioning settings of the positioning hole are two notches.

* * * * *